US007117692B1

(12) United States Patent
Su

(10) Patent No.: US 7,117,692 B1
(45) Date of Patent: Oct. 10, 2006

(54) YARN GUIDE OF A KNITTING MACHINE

(75) Inventor: Po-Hao Su, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/272,787

(22) Filed: Nov. 15, 2005

(51) Int. Cl.
*D04B 9/06* (2006.01)

(52) U.S. Cl. ..... 66/92

(58) Field of Classification Search ..... 66/191, 66/192, 91, 92, 125 R
See application file for complete search history.

(56) References Cited

U.S. PATENT DOCUMENTS

| | | | | |
|---|---|---|---|---|
| 3,726,112 | A * | 4/1973 | Roque | 66/95 |
| 3,964,275 | A * | 6/1976 | Busi et al. | 66/91 |
| 4,297,857 | A * | 11/1981 | Busi | 66/9 R |
| 4,796,444 | A * | 1/1989 | Tibbals, Jr. | 66/13 |
| 6,128,930 | A * | 10/2000 | Schmidt | 66/92 |

FOREIGN PATENT DOCUMENTS

| | | |
|---|---|---|
| TW | 376909 | 12/1999 |
| TW | 454770 | 9/2001 |
| TW | M247596 U | 10/2004 |

* cited by examiner

*Primary Examiner*—Danny Worrell
(74) *Attorney, Agent, or Firm*—Birch, Stewart, Kolasch & Birch, LLP

(57) ABSTRACT

A yarn guide of a knitting machine assists a knitting machine to weave a fabric having a yarn ring surface and comprised of a base yarn for forming a base fabric and a wool yarn for forming a yarn ring surface. A needle disc is shifted to enter the wool yarn and the base yarn respectively into a yarn hooking section and a first yarn hooking position of a needle latch. The needle disc continues shifting such that the base yarn is entered into a second yarn hooking position of the yarn hooking section. A knitting needle includes a yarn guide plate on a side so that the first yarn hooking position continues pressing the base yarn by the yarn guide plate. The second yarn hooking position drives the base yarn to weave the wool yarn into the base fabric under a counter wrap knitting status.

6 Claims, 6 Drawing Sheets

YARN GUIDE OF A KNITTING MACHINE

FIELD OF THE INVENTION

The present invention relates to a yarn guide of a knitting machine, and more particularly to a yarn guide of a knitting machine that assists two yarns to form a counter wrap knitting status.

BACKGROUND OF THE INVENTION

A towel fabric knitting method is a prior art in the textile industry, and the method includes a wrap knitting ring and a counter wrap knitting ring to wrap the bottom of a yarn ring. For example, the inventor of the present invention has filed and obtained R.O.C. Patent No. M247596 that discloses a single-sided counter wrap knitted towel sinker plate of a circular knitting machine, and the sinker plate is installed at the yarn looping position of the circular knitting machine with an inclined angle, and the sinker plate comprises a nose section, an abdomen section coupled with an end of the nose section, and a throat section coupled to another end of the nose section, and one side of the throat section includes a first distal surface and the abdomen section includes a second distal surface. When the sinker plate is installed at the circular knitting machine, the first distal surface is substantially in a horizontal plane and the second distal surface is an inclined plane, and a yarn loop is propped up to the highest horizontal position by the nose section.

R.O.C. Patent Publication No. 454770 has disclosed an improved needle tracks of a double-sided towel counter wrap knitting, which primarily designs the tip of a half needle section of a needle track of a knitting machine to be elevated, so that the knitting needle can operate with two sinker plates of different shapes to move alternately along the needle track, so as to hook and pull the wool loop and the base yarn to constitute the double-sided towel counter wrap knitting. When the knitting needle travels to the elevated area at the tip of the half needle section, the knitting needle is lifted by the elevated area to avoid the needle latch of the knitting needle from being squeezed by the sinker plate which will cause a broken yarn. R.O.C. Patent Publication No. 376909 had disclosed a novel caltrop-shaped structure of a counter wrap towel knitting machine comprises a first caltrop-shaped module, a second caltrop-shaped module, a third caltrop-shaped module, a fourth caltrop-shaped module, a fifth caltrop-shaped module, a sixth caltrop-shaped module, a seventh caltrop-shaped module, and an eighth caltrop-shaped module, and one of the first, second and third caltrop-shaped modules can be selected to fit the size of the sliding track and different sizes according to the user's requirements, so as to fine tune the yarn to have the desired length of the wool loop.

From the description above, a sinker plate or a caltrop-shaped module is used regardless of the warp knitting or counter warp knitting, and thus making the overall mechanical design more complicated and difficult. Therefore, it is an important subject for manufacturers in the textile field to design a simple mechanism for the wrap knitting or counter wrap knitting.

SUMMARY OF THE INVENTION

The primary objective of the present invention is to install a yarn guide plate on a side of a knitting needle, so that a wool yarn with an additional effect can be knitted into a base yarn in a counter wrap knitting status to produce the base fabric. When the wool yarn and the base yarn are hooked, the yarn guide plate presses the base yarn to the bottom of the wool yarn to define a counter wrap knitting status of two yarns, and thus achieving the effect of fixing the bottom of the wool yarn into the base fabric.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
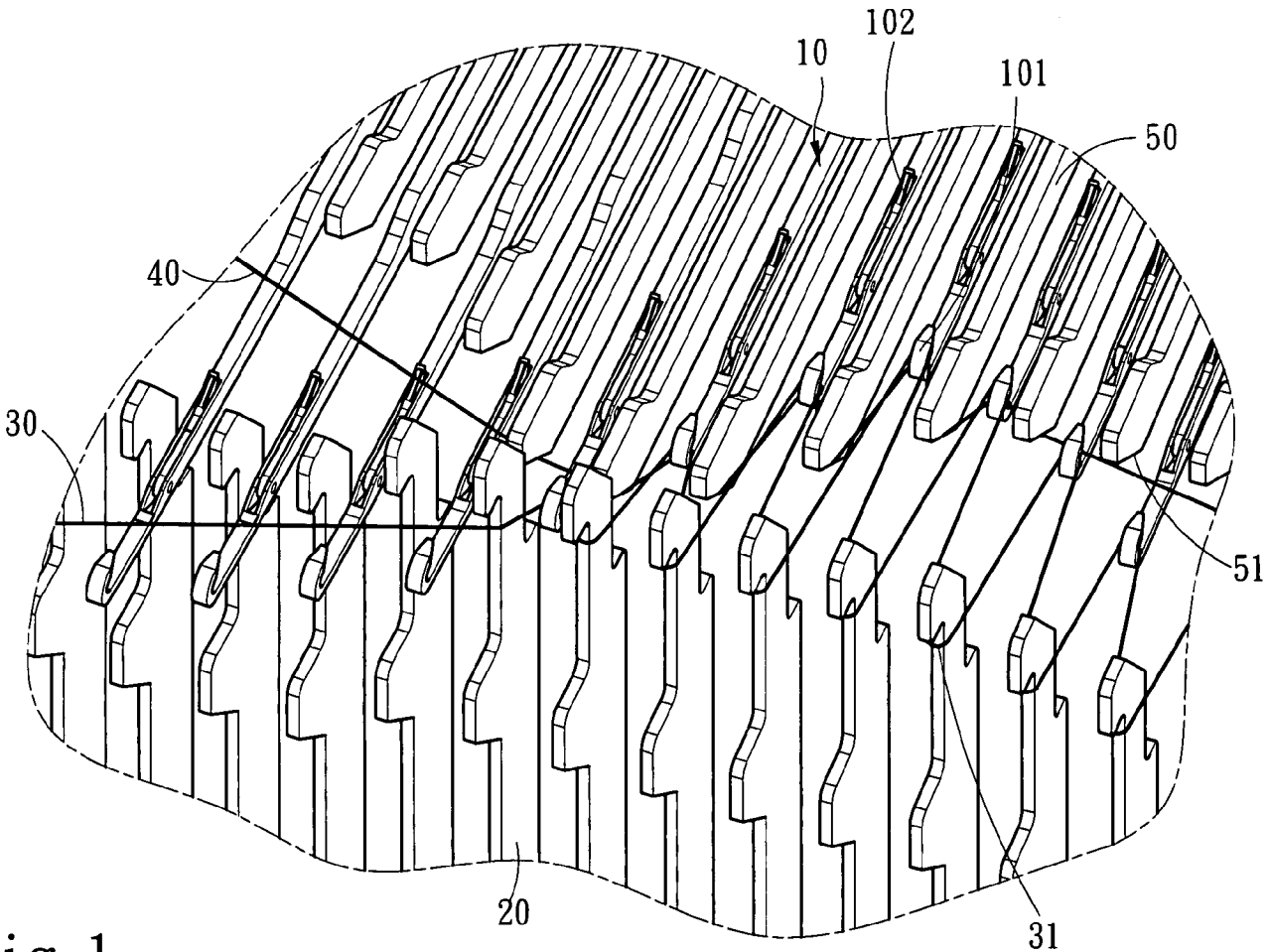
FIG. 1 is a perspective view of the invention.
Figure 2:
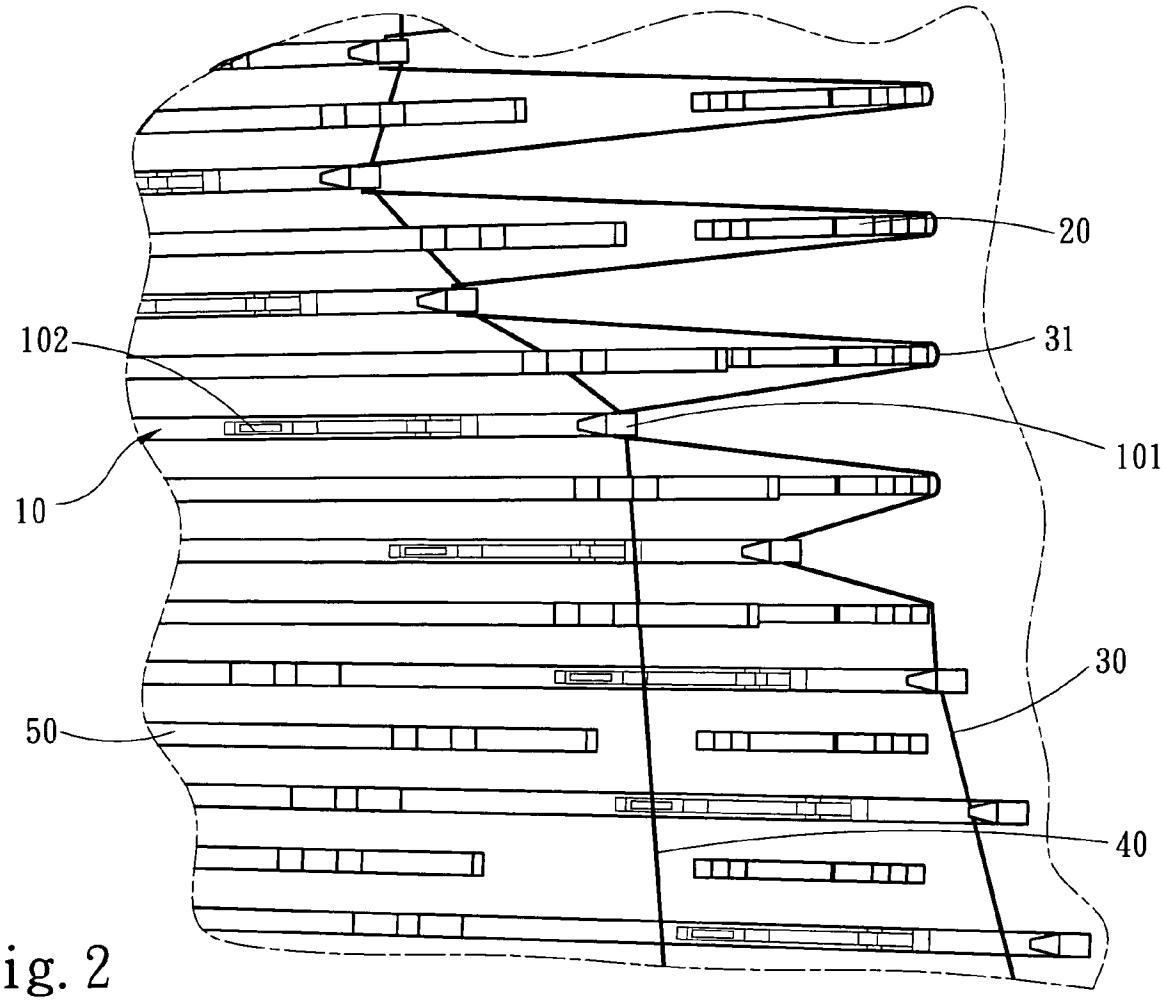
FIG. 2 is an exploded view of the structure of the invention.

Referring to FIGS. 1 and 2 for the perspective view and the bottom view of the present invention, a structure of a yarn guide plate 50 of a knitting machine comprises a needle disc and a needle barrel (not shown in the figure) which include a plurality of knitting needles 10 and a plurality of entry knitting needles 20 respectively, and the plurality of knitting needles 10 and the plurality of entry knitting needles 20 are installed alternately, so that the plurality of knitting needles 10 and the plurality of entry knitting needles 20 can carry out the weaving job of a fabric having a yarn ring surface on one side by the needle disc and the needle barrel, wherein the fabric includes a base yarn 40 for forming the base fabric of the fabric (not shown in the figure) and a wool yarn 30 for forming the yarn ring surface. In the figures, the wool yarn 30 is disposed at the external end of the knitting needle 10 and hooked to the wool yarn 30 by a needling action. Since the knitting needle 10 and the entry knitting needle 20 are installed alternately, therefore when the two knitting needles 10 hook the wool yarn 30, the wool yarn 30 will be sheathed onto the entry knitting needle 20 to form a yarn ring 31. After several times of the weaving process, the yarn ring 31 forms the foregoing yarn ring surface. The needle disc and the needle barrel continue moving to drive the knitting needle 10 which is hooked with the wool yarn 30 to hook the base yarn 40 and carry out the base fabric knitting procedure. In the meantime, the bottom of the yarn ring 31 is woven into the base fabric, so as to achieve the effect of fixing the yarn ring 31.

Figure 3A:
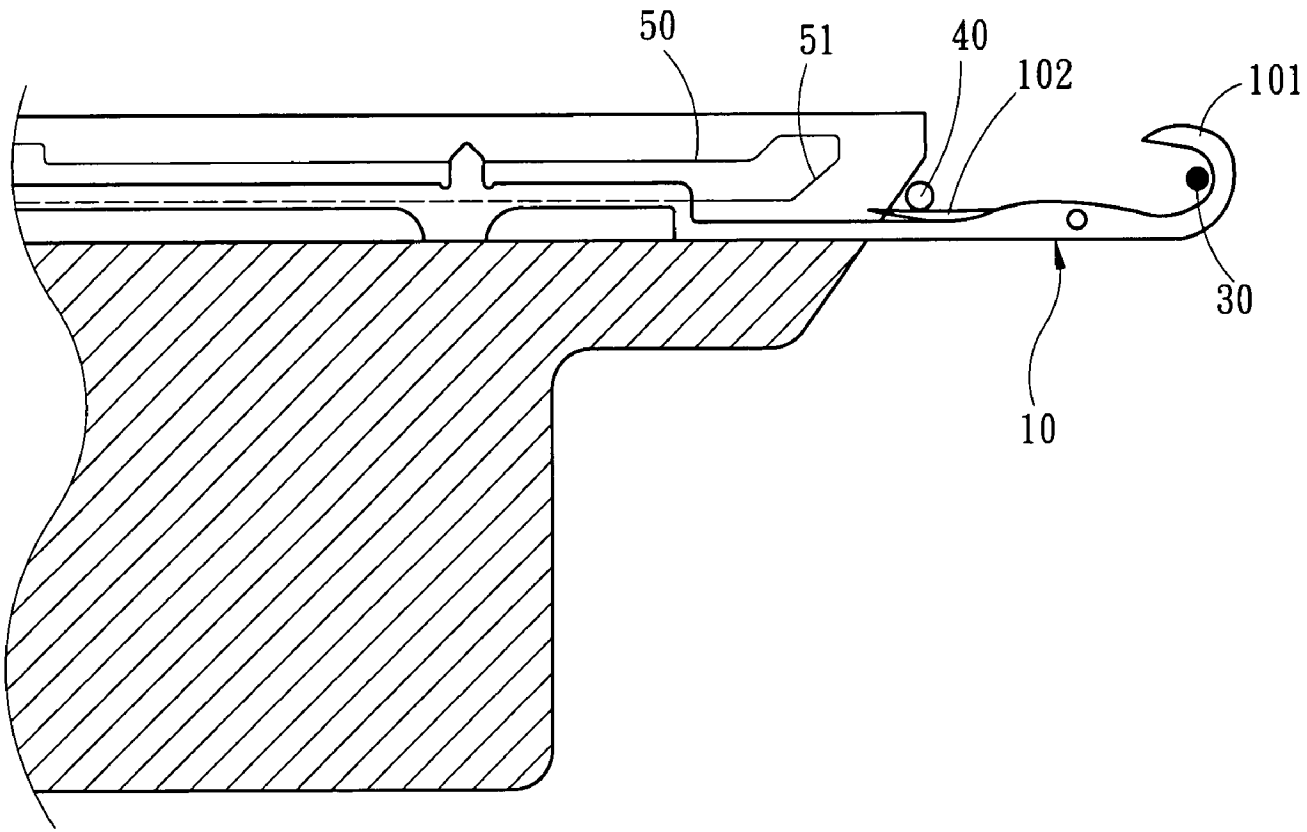
FIGS. 3A to 3D are schematic views of part of the assembly of the invention.
Figure 3B:
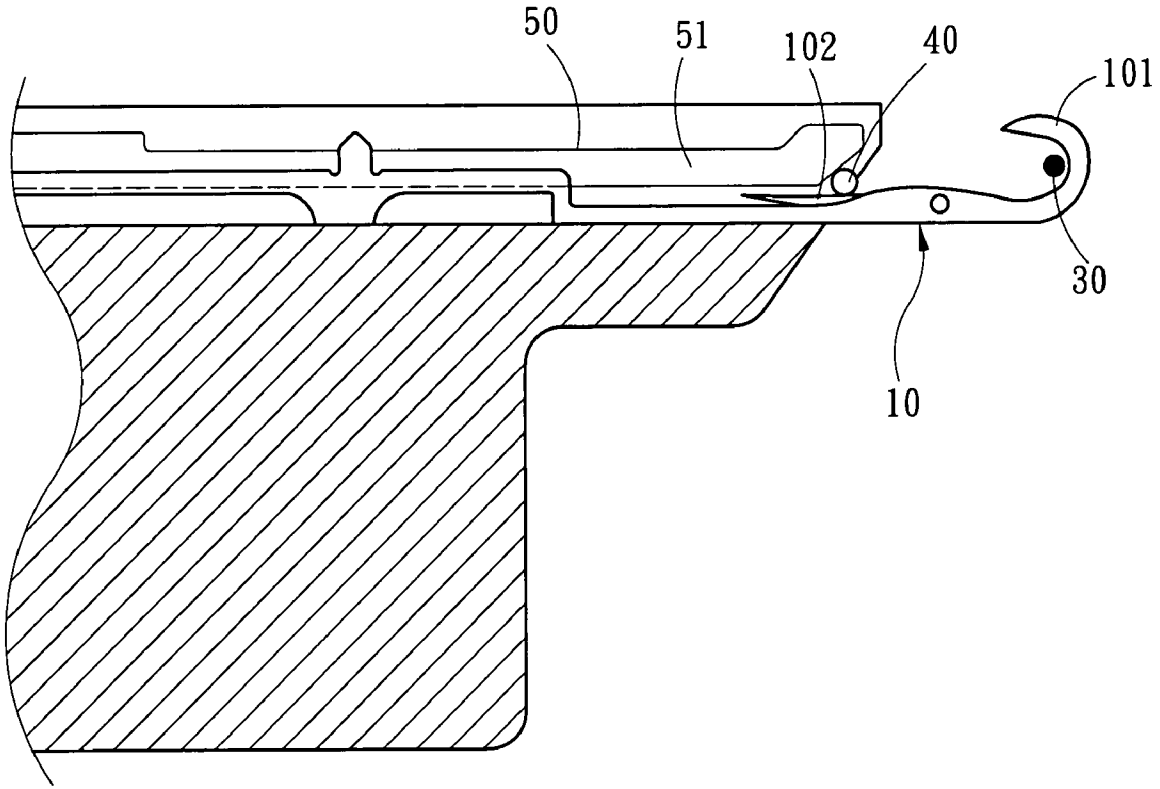
Figure 3C:
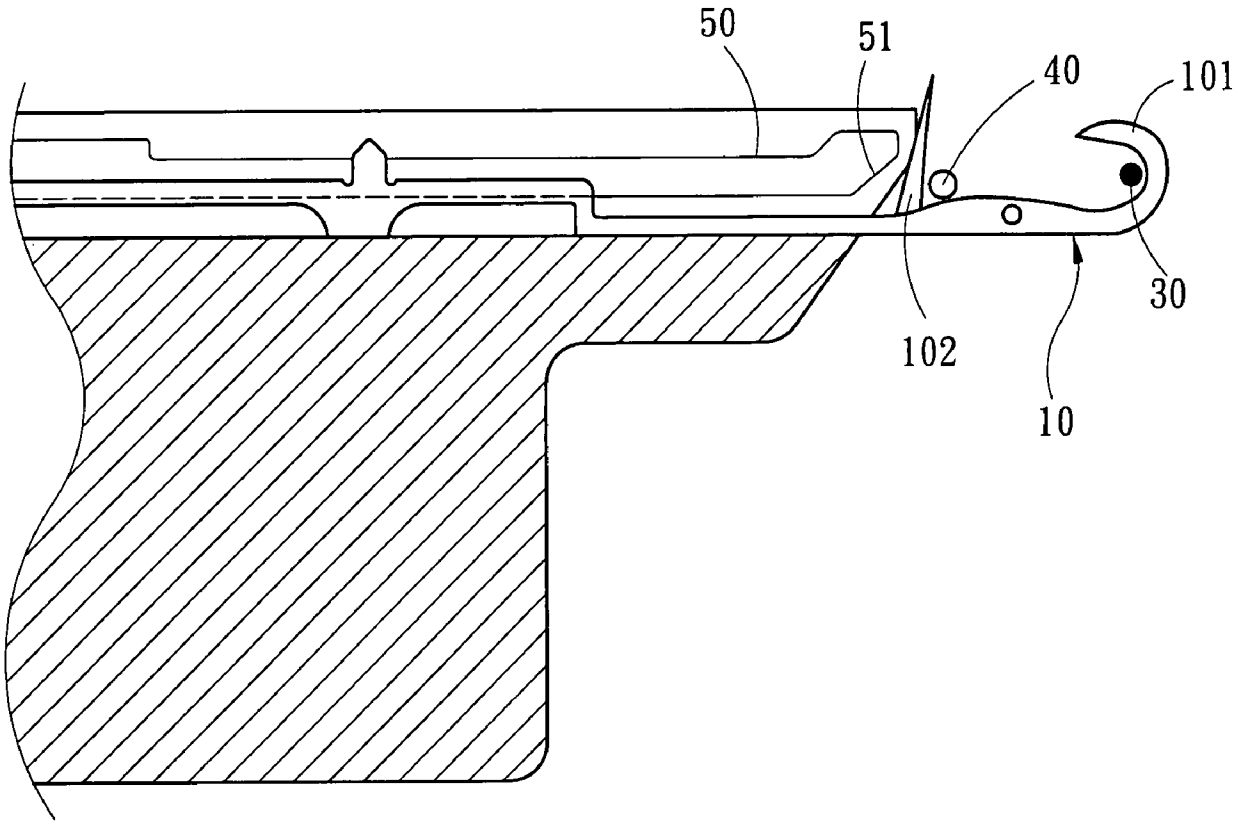
Figure 3D:
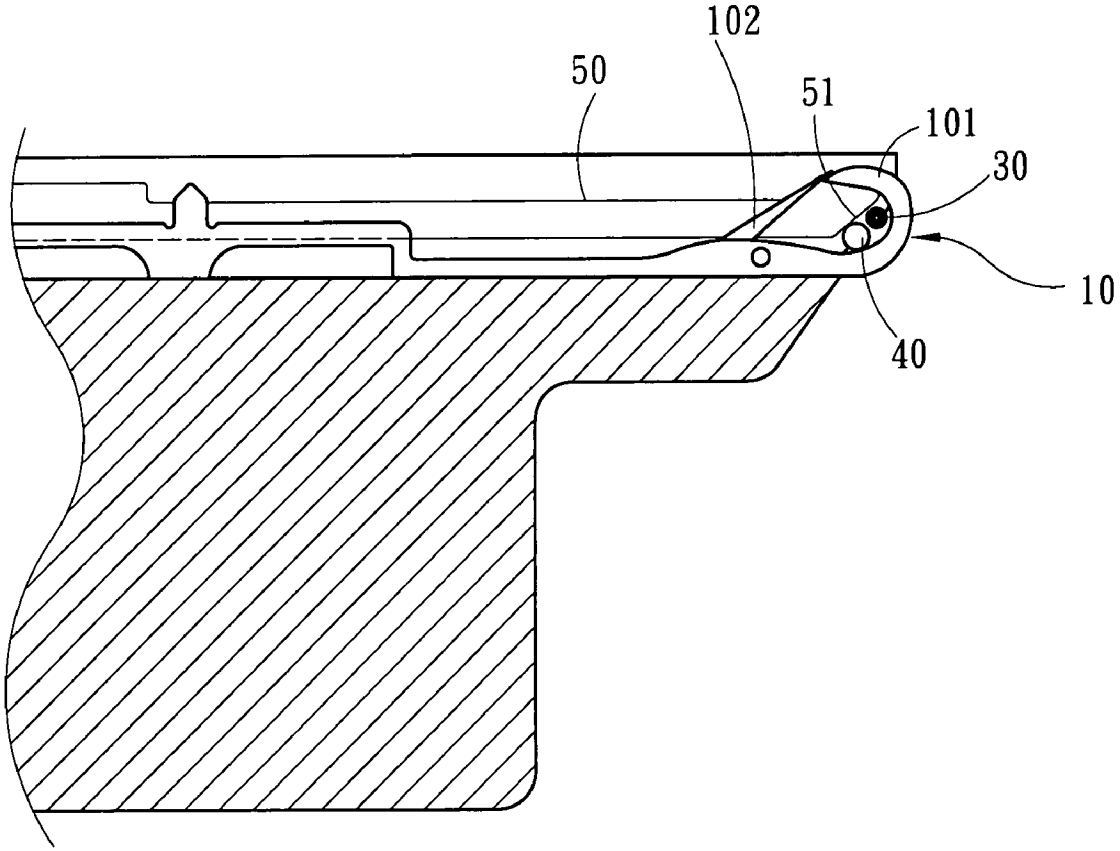

The key point of the present invention resides on that the counter wrap knitting method is used to weave the wool yarn 30 into the base fabric. Referring to FIGS. 2 and 3A to 3D for the explode view and schematic views of the movement of the present invention, the knitting needle 10 includes a yarn hooking section 101 for hooking yarns and a needle latch 102 for movably including yarns therein, and one side of the knitting needle 10 has a yarn guide plate 50 with an inclined surface 51, so that the needle disc can be shifted to drive the wool yarn 30 and the base yarn 40 into the yarn hooking section 101 and a first yarn hooking position of the needle latch 102. The needle disc continues shifting to enter the base yarn 40 into a second yarn hooking position of the yarn hooking section 101, and the yarn guide plate 50 presses the base yarn 40 at the first yarn hooking position (as shown in FIG. 3A) and the knitting needle 10 is drawn back by the continuous movement of the needle disc, such that the base yarn 40 advances gradually towards the yarn hooking section 101, but the base yarn 40 is still pressed by the inclined surface 51 of the yarn guide plate 50 to attach the surface the knitting needle 10 to advance (as shown in FIG. 3B). Until the base yarn 40 at the second yarn hooking position enters the yarn hooking section 101 and the needle latch 102 is covered and sealed, the base yarn 40 will be located under the wool yarn 30 (as shown in FIG. 3D). In the meantime, the wool yarn 30 is woven into the base fabric. The wool yarn 30 is at the top and the base yarn 40 is at the bottom and the status of weaving the base fabric which is the feature of the counter wrap knitting or the counter wrap knitting. The base yarn 40 weaves the wool yarn 30 into the base fabric on another side opposite to the yarn ring 31, and thus achieving the effect of fixing the bottom of the yarn ring 31 to the wool yarn 30. If the yarn ring 31 is pulled, the yarn ring 31 will not be loosened or fallen out from the base fabric easily.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A yarn guide of a knitting machine, installed to said knitting machine for assisting said knitting machine to knit a fabric having a pile loop, said yarn guide manipulates a base yarn for forming a base fabric of said fabric and a wool yarn for forming a pile loop, the yarn guide comprising;

a plurality of knitting needles disposed at a needle disc of said knitting machine, and each of said knitting needles include a yarn hooking section and a needle latch, said needle disc being shifted to respectively move said wool yarn and said base yarn into said yarn hook section and a first yarn hooking position of said needle latch, and said needle disc continues shifting to move said base yarn into a second yarn hooking position of said yarn hooking section; and a yarn guide plate disposed on a side of said knitting needle for pressing said first yarn hooking position to said base yarn, and said second yarn hooking position forms a counter warp knitting status with said wool yarn disposed above said base yarn.

2. The yarn guide of a knitting machine of claim 1, wherein the yarn guide plate includes an inclined surface for pressing said base yarn.

3. The yarn guide of a knitting machine of claim 1, further comprising a plurality of entry knitting needles disposed at a needle barrel of said knitting machine, said plurality of entry knitting needles and said plurality of knitting needles alternating for sheathing said wool yarn to produce said pile loop.

4. The yarn guide of a knitting machine of claim 3, wherein the wool yarn at a bottom of said pile loop knits said base yarn into the base fabric by counter wrap knitting.

5. The yarn guide of a knitting machine of claim 2, wherein said plurality of knitting needles and the yarn guide plate are reciprocable in a horizontal direction, the inclined surface of the yarn guide plate presses the base yarn downwardly toward the knitting needles and further moves the base yarn horizontally toward the hooking section of the knitting needles.

6. The yarn guide of a knitting machine of claim 5, further comprising a plurality of vertically disposed entry knitting needles, the entry knitting needles being disposed outwardly of the yarn guide plate and the plurality of knitting needles being movable past the plurality of entry knitting needles.

* * * * *